US006090015A

United States Patent [19]

Meyers

[11] Patent Number: 6,090,015

[45] Date of Patent: Jul. 18, 2000

[54] AID FOR CROSSOVER SKATING TECHNIQUE

[76] Inventor: David W. Meyers, 9816 Regent Ave., Brooklyn Park, Minn. 55443

[21] Appl. No.: 08/967,726

[22] Filed: Nov. 10, 1997

Related U.S. Application Data

[63] Continuation-in-part of application No. 08/521,135, Aug. 29, 1995, abandoned.

[51] Int. Cl.[7] ..... A63B 22/02; A63B 22/00

[52] U.S. Cl. ..... 482/54; 482/51; 482/74

[58] Field of Search ..... 482/51, 54, 57, 482/66, 68, 909, 148, 69, 74, 71; 472/15; 119/700, 701, 703, 704

[56] References Cited

U.S. PATENT DOCUMENTS

| | | | |
|---|---|---|---|
| 229,541 | 7/1880 | Magner . | |
| 329,989 | 11/1885 | Woodworth | 482/54 |
| 748,700 | 1/1904 | Carson . | |
| 877,504 | 1/1908 | Hoover . | |
| 903,731 | 11/1908 | Kull | 482/54 |
| 1,521,946 | 1/1925 | Hargreaves | 482/54 |
| 2,499,164 | 2/1950 | Richardson | 482/54 |
| 2,785,896 | 3/1957 | Ellis | 482/54 |
| 2,831,457 | 4/1958 | McMurry | 119/29 |
| 3,171,651 | 3/1965 | Merdich et al. | 472/15 |
| 3,716,029 | 2/1973 | Pillsbury, Jr. | 119/29 |
| 4,340,214 | 7/1982 | Schutzer | 272/70 |
| 4,766,848 | 8/1988 | Rocco et al. | 119/29 |
| 4,915,373 | 4/1990 | Walker | 272/70 |
| 5,284,460 | 2/1994 | Miller et al. | 482/51 |
| 5,352,170 | 10/1994 | Condo et al. | 482/83 |
| 5,385,520 | 1/1995 | Lepine et al. | 482/54 |
| 5,433,682 | 7/1995 | Fermaglich et al. | 482/66 |

FOREIGN PATENT DOCUMENTS

| | | | |
|---|---|---|---|
| 0515516 | 5/1976 | U.S.S.R. | 482/51 |
| 1044295 | 9/1983 | U.S.S.R. | 482/69 |

*Primary Examiner*—Stephen R. Crow
*Attorney, Agent, or Firm*—Kinney & Lange

[57] ABSTRACT

An exercise apparatus, the apparatus including a first member disposed along a first axis that intersects a ground surface, a radial member attached to the first member, and a support surface configured for movement of the support surface along an arcuate path relative to the first member and relative to the ground surface.

21 Claims, 7 Drawing Sheets

310
316
70
77
10
D
40
60
322
320
A
30
12
314
318
A
J
I
$I_1$
$I_2$
312
324

AID FOR CROSSOVER SKATING TECHNIQUE

This application is a continuation in part of application Ser. No. 08/521,135 that was filed on Aug. 29, 1995, now abandoned.

BACKGROUND OF THE INVENTION

The present invention generally relates to an exercise device for use by a person while training along an arcuate path. The present invention also relates to an exercise device for a person wearing skates that allows the person to train and exercise at a proper height and orientation and in a balanced stance during either static or dynamic training or exercising activities.

Persons who wear skates, such as ice skates and roller skates, and persons who wear skis, such as water skis and snow skis, have been able to train and exercise using a variety of training aids and exercise devices. These aids and devices typically permit the person to learn correct body orientation and balance and also help develop muscle groups required for the skating or skiing activity.

One example of an existing training apparatus is disclosed in U.S. Pat. No. 4,340,214 to Schutzer. The Schutzer device is similar to the slideboard which is well known among serious skaters. The Schutzer device provides a lateral inclined track which allows side-to-side motion and stretching of the feet and legs. An upright support at the center of the Schutzer device helps maintain the user's body in the correct skating position.

U.S. Pat. No. 4,915,373 to Walker discloses an exercise machine for developing ice skating skills. The Walker machine includes a bicycle-type saddle in the center for seating the user in a crouching position. Foot stirrups that are intended to approximate the skating motion ride in two triangular tracks on either side of the saddle. A portion of each track is designated as a power section and is provided with means for creating drag on the stirrups as the stirrups pass through the power section. The drag created by passage of the stirrups through the power section requires greater exertion of force by the user to move the stirrups through the power section.

U.S. Pat. No. 5,284,460 to Miller discloses a device that is similar to the Walker and Schutzer devices. The Miller device is essentially a stationary training device with a central support that is located behind the skater. The central support allows the skater's trunk to remain in a fixed location in relation to the central support while allowing the skater to freely move his or her feet in a side-to-side skating motion.

U.S. Pat. No. 5,385,520 to Lepine discloses a treadmill for practicing ice skating techniques while permitting close range observation of the skating technique in a controlled off-ice environment. The treadmill includes a motorized, rotating, endless belt that offers the skater a stationary platform for developing skating technique. The artificial environment of the Lepine device assists the user in developing either forward or backward skating technique, but does not address techniques for skating along an arcuate path. Additionally, the artificial environment does not allow the skater to practice skating techniques on a real-live skating surface, such as ice or land.

The act of wearing a pair of skates or skis produces the advantage of reduced friction with the skating or skiing surface so that the person wearing the skates or skis can glide across the surface. The reduced friction permits skaters and skiers to use less energy in producing and maintaining the momentum needed to glide across the skating or skiing surface.

The inherent difficulty with skating and skiing is that the reduced friction often accelerates unbalanced movements when the person's center of gravity is not balanced directly over the person's feet and helps cause the person to fall. To avoid unbalanced movements, the person must quickly and correctly move the feet, while maintaining proper body stance, to counteract the forces causing the unbalanced movements. Vulnerability to failing is especially pronounced in persons who are first learning how to ski or skate. Also, more advanced skiing and skating techniques that require shifting the body's center of gravity to a position that is not directly over the feet often produces a loss of balance if the center of gravity is not quickly and correctly shifted in a coordinated movement.

These problems relating to adequate control of the body's center of gravity exist when the skater or skier is learning to move forward and are even more pronounced for persons who are learning to move backward. Also, skaters and skiers who are learning to turn, corner, or otherwise move along an arcuate path often experience problems relating to adequate control of the body's center of gravity.

Some of the forces that act on a person who is skating or skiing along an arcuate path are centrifugal in nature. The centrifugal forces acting on the person are applied to the person's center of gravity and produce a moment about the point where the skate blade or wheel contacts the skating surface or where the ski contacts the skiing surface.

This moment produces a rotational acceleration of the individual that may force the skate blade, skate wheel, or ski to deviate from the arcuate path and may also cause the person to lose his or her balance and fall. In order to continue traveling along the arcuate path without falling, the individual must counteract the centrifugal force by applying a counterbalancing force to the skate blade, skate wheel, or ski. The counterbalancing force should be oriented directly to the center point that defines the arcuate path or arcuate path segment.

There is a need for a device that allows skaters and skiers to learn and perfect proper body orientation and positioning and proper techniques for applying forces that counterbalance centrifugal forces encountered when skating or skiing along an arcuate path. No existing device, including the aforementioned Schutzer, Walker, Miller, and Lepine devices, permits persons of all experience levels—from beginner to expert—to train in a dynamic environment while learning and perfecting the proper body orientation, positioning, and force application needed when skating or skiing along an arcuate path.

One make-shift technique for teaching arcuate path travel does exist. This technique involves a trainer who stands at the center of a radial path. The trainer holds onto one end of a hockey stick or a ski pole and stands at the center of a radial path. The skater or skier holds onto the other tend of the stick or pole and skates or skis about the trainer along the radial path. This technique is of limited usefulness because the trainer standing at the center of the radial path rotates with the skater or skier and quickly becomes tired, dizzy, and disoriented.

A need also exists for a device that allows a stationary skater or skier to learn proper body orientation and positioning for applying correct counterbalancing force. Such a device would permit a trainer to demonstrate discreet elements of the proper skating technique and to observe and modify particular aspects of the person's skating or skiing technique in a controlled environment.

SUMMARY OF THE INVENTION

The present invention includes an exercise apparatus. The apparatus includes a first member that is disposed along a first axis that intersects a ground surface. The apparatus also includes a radial member that is attached to the first member. The apparatus further includes a support surface that is configured for movement along an arcuate path relative to the first member and relative to the ground surface. The present invention also includes a skate training apparatus usable on a skating surface. The present invention further includes a method usable by a person wearing skates for practicing a cross-over skating technique on a skating surface.

DETAILED DESCRIPTION OF THE PREFERRED EMBODIMENTS

Figure 1:
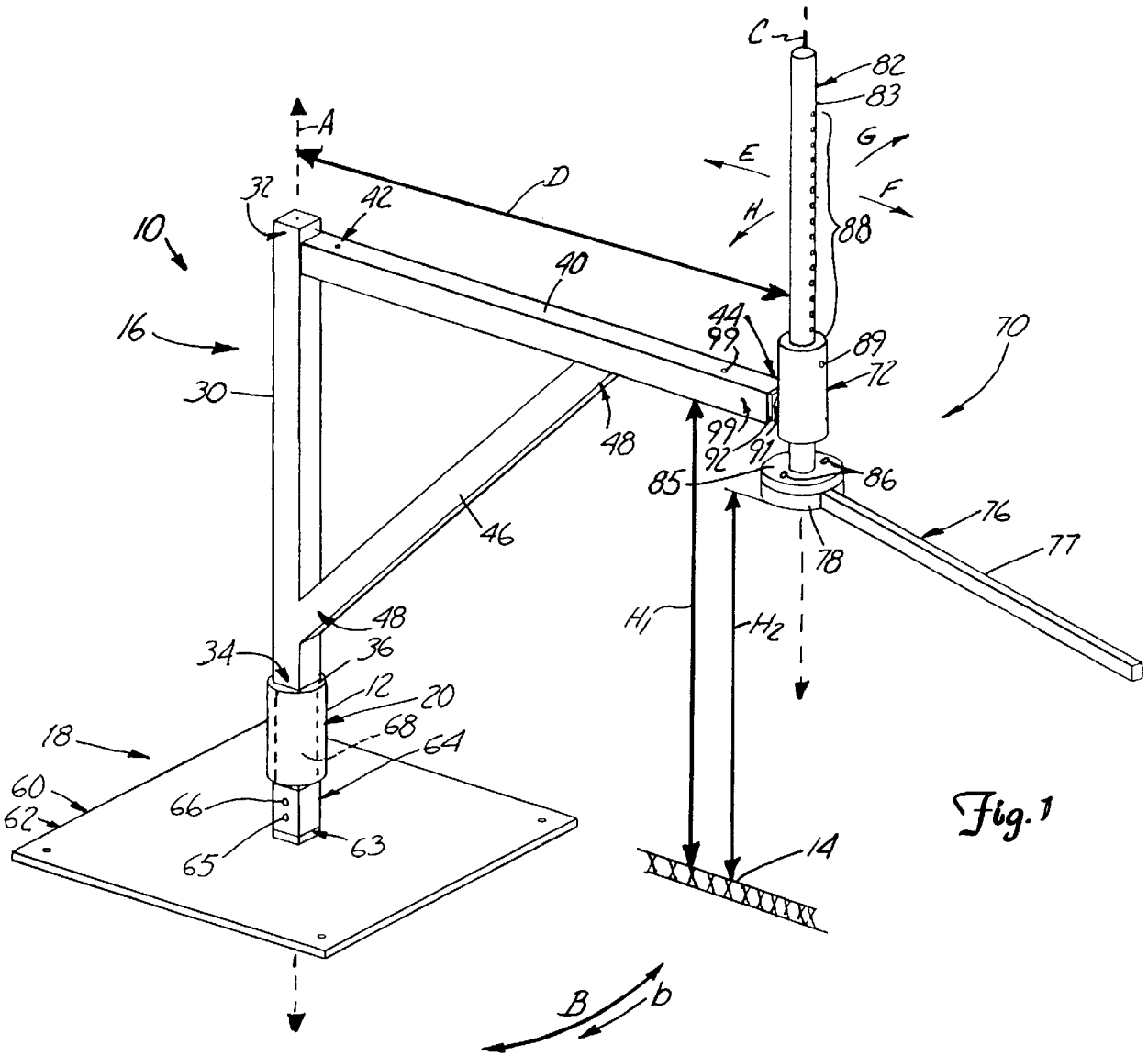
FIG. 1 is a perspective view of a training apparatus of the present invention.
Figure 2:
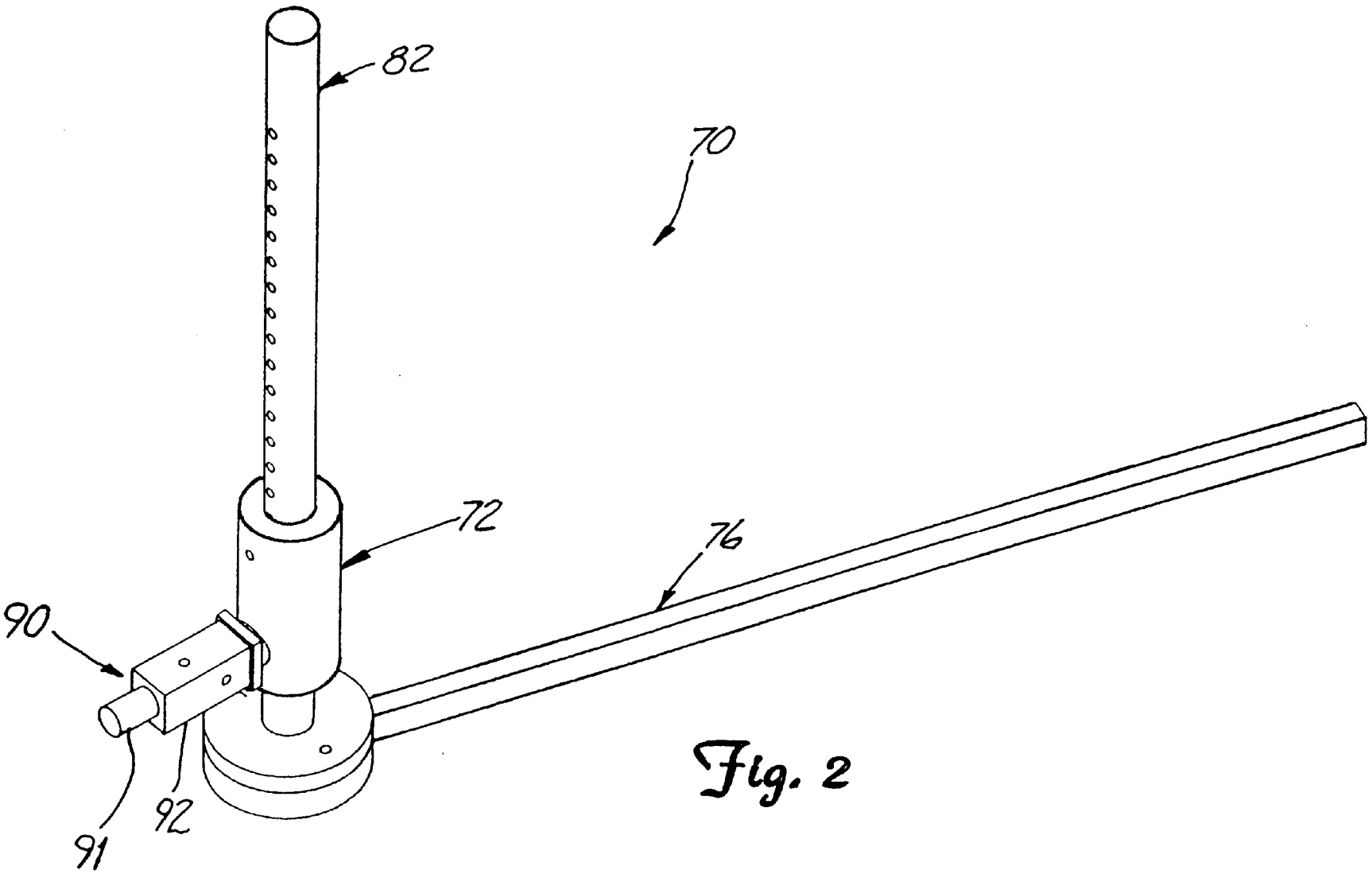
FIG. 2 is a perspective view of an adjustable body support device of the training apparatus of the present invention.

A training apparatus of the present invention is generally indicated at 10 in FIG. 1. The apparatus 10 includes a pivot mechanism, such as a bushing, a bearing, or a swivel 12, that is positioned along an axis A. The axis A intersects a surface 14. In addition to the swivel 12, the apparatus 10 also includes a rotatable support 16 that is attached to the swivel 12 for rotation about axis A. The rotatable support 16 is capable of being grasped by a skater (not shown) to support the skater. The apparatus 10 of the present invention also includes a stationary support, such as a center support 18, that secures the swivel 12 and the rotatable support 16 in working relationship with the surface 14.

The training apparatus 10 of the present invention permits a person who is wearing skates, such as ice skates or roller skates, or a person who is wearing skis, such as water skis or snow skis, to train and exercise in a balanced stance at a correct height during either static or dynamic training or exercising activities. Figure skates, hockey skates, and speed skates are some examples of the types of ice skates people can wear while using the apparatus 10. Some examples of roller skates people can wear while using the apparatus 10 include in-line skates and skates having two or more wheel tracks. The training apparatus 10 of the present invention also permits a person, such as an amputee or a person with a leg disability, who is wearing a single skate or ski to train in a balanced stance during either static or dynamic training or exercising activities.

The training apparatus 10 is capable of fully supporting the skater or skier during both static and dynamic training activities. The apparatus 10 also helps the skater or skier to establish and maintain proper body position and orientation for balancing and efficiently applying skating or skiing force while skating or skiing. The training apparatus 10 is especially beneficial for skaters and skiers who are learning or practicing turning, cornering, or otherwise moving along an arcuate path, since arcuate maneuvers frequently cause problems relating to adequate control of the body's center of gravity.

The swivel 12 of the training apparatus 10 includes an outer case 20 nd a bearing assembly (not shown) that is aligned along axis A and is contained within the outer case 20. The bearing assembly includes a bearing (not shown) that is capable of handling radial loads that are directed perpendicular to axis A. Preferably, the bearing is a radial/thrust type bearing, such as a deep-groove ball bearing or a ball thrust bearing, that is capable of handling both radial loads that are directed perpendicular to axis A and also thrust loads that are directed parallel to axis A. The swivel 12 permits free or substantially free rotation of the rotatable support 16 about axis A.

The rotatable support 16 includes a vertical support portion 30 with upper and lower ends 32 and 34. The lower end 34 of the vertical support 30 is fixedly attached to a top side 36 of the outer case 20. The vertical support portion 30 is preferably aligned along axis A. The rotatable support 16 also includes a boom, such as a support arm 40 with a proximal end 42 and a distal end 44. The support arm 40 is attached at the proximal end 42 to the upper end 32 of the vertical support portion 30. The support arm 40 is preferably perpendicular to axis A and is preferably substantially parallel to the surface 14 so that the distal end 44 of the support aim 40 remains at substantially the same height $H_1$ above the surface 14 as the rotatable support 16 pivots about axis A.

The rotatable support 16 preferably also includes an angular brace 46 with ends 48. One of the ends 48 is attached to the vertical support 30 proximate the lower end 34 and another of the ends 38 is attached to the support arm 40 between the proximal end 42 and the distal end 44. The brace 46 stiffens and strengthens the rotatable support 16.

Components of the rotatable support 16, including the vertical support portion 30, the support arm 40 and the angular brace 46, may be made of any suitable high strength material, including metal and high strength plastic. Preferably, the vertical support portion 30, the support arm 40, and the angular race 46 are made of aluminum tubing that is rectangular in cross section. The vertical support portion 30, the support arm 40, and the angular brace 46 may be fixedly attached to each other, such as by welding, or may be releasably attached to each other using conventional techniques, such as cotter pin/bore attachments.

The training apparatus 10 of the present invention also includes the center support 18 that holds the swivel 12 in position along axis A and also maintains the position of the rotatable support 16 with respect to the surface 14. The center support 18 includes a base 60, such as a base plate 62, with an attached boss 63, and also includes an extension 64 that slidably fits over the boss 63. The extension 64 and the boss 63 may be fixed together or may be releasably attached, such as by inserting a cotter pin or other fastening mechanism (not shown) though a hole 65 bored through the extension 64 and a hole (not shown) bored through the boss 63, with the hole through the boss 63 being aligned with the hole 65. The center support 18 substantially, and preferably fully, prevents movement of axis A with respect to the surface 14. To accomplish this, the base 60 may be fixedly attached to the surface 14. Alternatively, the base 60 may be provided with adequate dimensions, adequate weight, or an adequate combination of dimensions and weight to counterbalance any forces that are applied to the rotatable support 16 during use of the apparatus 10.

The center support 18 also includes a cylindrical tube or rod 68 (shown in phantom in FIG. 1) that is oriented along axis A. One end of the cylindrical tube 68 fits within the swivel 12 and another end of the cylindrical tube 68 fits within the extension 64. The bearing located within the swivel 12 engages and rides along the outer radial surface of the cylindrical tube 68. The tube 68 preferably includes a mechanism, such as a shoulder (not shown) at an upper end of the tube 68, that prevents the tube 68 from moving longitudinally (along A axis) with respect to the bearing.

The end of the cylindrical tube 68 that fits within the extension 64 is fixed within the extension 64 to prevent rotation of the cylindrical tube 68 with respect to axis A and the support 18. The cylindrical tube 68 may be locked in the extension 64 to prevent rotation of the cylindrical tube 68 using any conventual technique. One such technique entails insertion of a cotter pin or other fastening mechanism (not shown) though a hole 66 bored through the extension 64 and a hole (not shown) bored through the cylindrical tube 68, with the hole in the tube 68 being aligned with the hole 66. Preferably, the pin or fastening means extends all the way through both the extension 64 and the cylindrical tube 68.

Components of the center support 18, including the base 60, such as the base plate 62, the boss 63, the extension 64, and the cylindrical tube 68, may be made of any suitable high strength material, including metal and high strength plastic. Preferably, the base 60 is made of aluminum plate, the boss 63 is made of cast aluminum, the extension 64 is made of aluminum tubing of rectangular cross section, and the cylindrical tube 68 is made of aluminum tubing of cylindrical cross section.

Axis A is preferably maintained perpendicular to the surface 14 so that the distance between components of the rotatable support 16 and the surface 14 stays approximately the same as the support 16 rotates about axis A. The surface 14 may be formed of any suitable material, including ski-able or skate-able materials such as concrete, asphalt, wood, ice, simulated ice, snow, and water. The material that forms the surface 14 proximate the base 60 may be different from the material that forms the surface 14 proximate an arcuate path B that a skater grasping the support 16 defines while rotating about axis A. As an example, the surface 14 proximate the base 60 could be made from concrete, while the surface 14 proximate the arcuate path B could be simulated ice.

All subsequent comments about the trig apparatus 10 and variations of the training apparatus 10 are stated in terms of skating and skaters, though it is to be understood that subsequent comments are equally applicable to skiing and skiers, unless otherwise specified. All subsequent comments also apply to skaters or skiers wearing only a single skate or ski.

The skater may grasp the rotatable support 16, such as proximate the distal end 44 of the support arm 40, while positioning the skates to place the skaters center of gravity in an offset condition—that is—not positioned directly over the skates. Absent grasping the rotatable support 16, the skater's offset center of gravity would sometimes cause the skater to fall. However, since the skater is grasping the rotatable support 16, the skater, while remaining stationary, is able to stay upright on the skates and practice proper body orientation and force application for counterbalancing the offset center of gravity.

The training apparatus 10 also permits skaters to learn proper body orientation and force application for arcuate travel while actually skating. The skater who grasps the support 16 defines the arcuate path B, typically a circular path, while rotating about axis A. The skater may use the apparatus 10 while learning to skate in either a forward or backward direction (not shown) along the arcuate path B. As with the above description of static training, the person grasps the rotatable support 16, such as proximate the distal end 44 of the support arm 40, while initially placing the body in an out of balance orientation with the center of gravity offset from the skates. As the person travels along the arcuate path, the person can learn the body positions, body orientation, balance, and force application that are required at different rotational speeds to rebalance the center of gravity and counteract centrifugal forces generated by travel along the arcuate path.

The training apparatus 10 has been found to be particularly useful for teaching the cross-over skating technique to ice skaters, such as hockey, figure, and speed skaters and to roller skaters, such as in-line skaters. Cross-over skating is a technique for maximizing speed, control, and power application, for skaters traveling along an arcuate route, such as along the arcuate path B or the circular path about axis A. Typically, control is maximized and speed loss is minimized when the skater maximizes the time when the skates are in contact with the skating surface. The cross-over skating technique teaches the skater to equally and effectively use both skate blades while traveling either forward or backward in either a left arcuate or right arcuate direction along the arcuate path B. Proper use of the cross-over technique will increase the skater's speed. Proper use of the crossover technique will also increase leg muscle efficiency at counterbalancing centrifugal forces that tend to cause deviation from the arcuate path.

The cross-over technique is basically a method for crossing the skates in front of each other during the skating exercise. For a skater proceeding forward in a left arcuate direction and starting with the right skate at the end of a power stroke, the right skate (the "resting" skate) is improved in a forward direction several inches ahead of the left skate (the "power" skate). The power skate (the left skate) is concurrently moved outward away from the center point that defines the arcuate path B to counterbalance centrifugal force acting on the skater and propel the skater forward along the arcuate path B.

While the resting skate (the right skate) is being moved ahead of the power skate (the left skate), the resting skate is also moved toward the center (IE: toward axis A) of the arcuate or circular path, as compared to the power skate. Depending upon the skater's speed and desired acceleration or deceleration, the resting skate may be moved from several inches to as much as a few feet inward toward the center of the arcuate or circular path, as compared to power skate. As the right skate (resting skate) reaches the forward, inside position, and the left skate (power skate) reaches the rear, outside position, the eight skate becomes the power skate that is used to push outward for powering the forward, arcuate motion and the left skate becomes the resting skate that is moved forward in preparation for becoming the next power skate. This cycle is repeated in alternating, repetitive sequence by the left and right skates to move the skater along the arcuate path quickly and with maximum utilization of the skater's energy.

The cross-over technique has been found to be superior to other skating techniques, such as those where the left and right skates do not cross in front and toward the inside of each other, for maximizing speed, control and power application while turning, cornering, or otherwise traveling along an arcuate route. It has also been found that the training apparatus 10 of the present invention is well adapted to teaching proper cross-over skating technique. As with other techniques for moving along the arcuate path, centrifugal forces increasingly act on the body at faster speeds and as the arcuate path tightens.

Without added support, such as that provided by the apparatus 10, it is not possible for a freestanding skater, who is either remaining stationary or traveling at low speeds along an arcuate path, to learn the cross-over skating technique for counterbalancing centrifugal forces present at higher speeds. This impossibility arises because the body positioning and orientation and muscle application needed at faster speeds would force the body's center of gravity out of balance at lower speeds or while remaining stationary and would allow the body to fall.

However, when the skater grasps the support 16, while learning the cross-over skating technique for countering centrifugal forces present at higher speeds, the skater does not fall, even at lower speeds or while remaining stationary, because the support 16 fully supports the skater, despite the skater's offset center of gravity. Thus, the skater may use the apparatus 10, while remaining stationary or while traveling at low speeds, to learn proper body positioning and orientation and muscle application for counterbalancing centrifugal forces present at higher speeds, without falling down. Of course, the skater nay also use the apparatus 10, while traveling at low speeds, to learn proper body positioning and orientation and muscle application for counterbalancing centrifugal forces present at higher speeds, without falling down.

Figure 3:
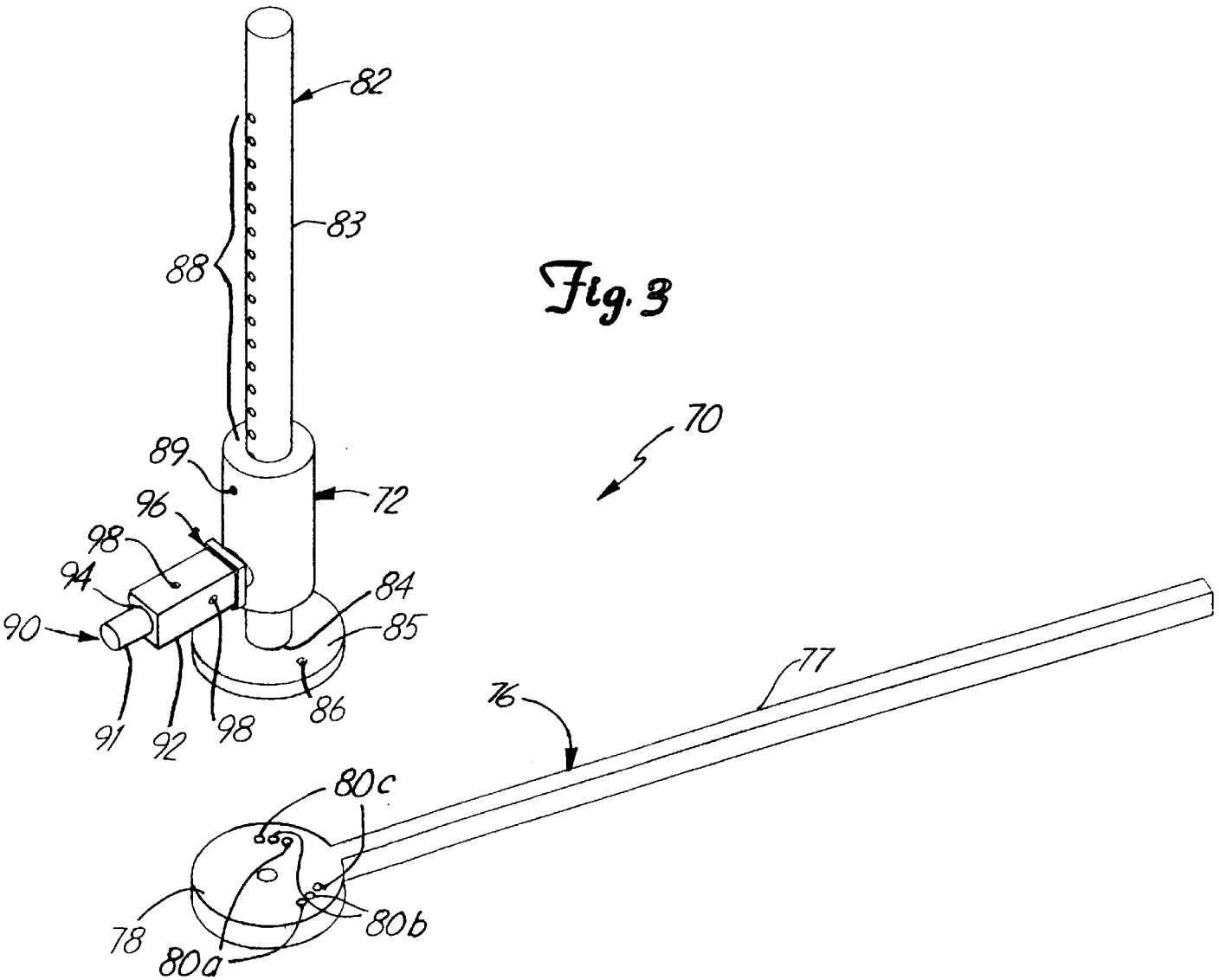
FIG. 3 is a partially exploded perspective view of the body support device depicted in FIG. 2.

The rotational support 16 may optionally include an adjustable body support device 70. The body support device 70 includes a guide, such as a bushing, collar, or sleeve 72; a support arm structure 76; and a riser portion 82. The sleeve 72 is aligned along an axis C that is preferably substantially parallel to axis A. The support arm structure 76 includes an arm 77 that is fixedly attached to a flange 78. The flange 78 includes a plurality of pairs of bores 80*a*, 80*b*, 80*c*, as best depicted in FIG. 3, that extend through both faces of the flange 78. The flange 78 also includes a bore (not shown) that extends along the central axis of the flange 78 through the faces of the flange 78.

The riser portion 82 includes a shaft 83 with a bottom end 84 and a flange 85 that is normally held in place against the bottom end 84 of the shaft 83. The bottom end 84 of the shaft 83 includes a threaded bore (not shown) that is substantially aligned with the longitudinal axis of the shaft 83. The shaft 83 also includes a plurality of bores 88 that are distributed along the shaft 83 and extend through the shaft 83, via the longitudinal axis of the shaft 83.

The flange 85 includes a pair of bores 86 that extend through both faces of the flange 85. The bores 86 are capable of being placed in alignment with the bores 80*a*, the bores 80*b*, or the bores 80*c*, depending upon the rotational orientation of flange 78 relative to the flange 85. The flange 85 also includes a bore (not shown) that extends along the central axis of the flange 85 through the faces of the flange 85. The bore that extends along the central axis of the flange 78 and the bore that extends along the central axis of the flange 85 preferably have the same diameter.

The shaft 83 is slidably received within the sleeve 72. The sleeve 72 includes a pair of bores 89 (only one of the bores 89 is visible at a time in the Figures) that are in alignment with each other. The shaft 83 may be fixed relative to the sleeve 72 by aligning the bores 89 of the sleeve 72 with any one of the bores 88 of the shaft 83 and then inserting a fastening mechanism, such as a cotter pin (not shown), through the bores 89 and the bore 88. Also, a height $H_2$ of the support arm structure 76 above the surface 14 may be readily adjusted by removing the pin from the bores 88, 89; aligning a different one of the bores 88 with the bores 89; and replacing the pin through the bores 89 and the different bore 88. The height $H_2$ is preferably adjustable in a suitable range, such as from about two feet to about four feet, so that the support arm structure 76 may be adjusted to be approximately at waist height for both young and older persons who use the training apparatus 10 for arcuate path training or exercising.

The support arm structure 76 may be attached to the riser portion 82 by aligning the bore that extends along the central axis of the flange 78, the bore that extends along the central axis of the flange 85, and the threaded bore that extends into the bottom end 84 of the shaft 83. Next, a threaded stud (not shown), with a cap end and a smooth shoulder that is located between the cap end and the threads, is inserted through the central bores of the flanges 78, 85 and is threaded into the threaded bore in the bottom end 84 of the shaft 83. The combined width, face to face, of the flanges 78, 85 is equal to the length of the smooth shoulder, and the diameters of the smooth shoulder and the flange 78, 85 central bores are approximately the same.

Before the threaded stud is tightened to secure the flange 85 against the end 84 of the shaft 83 and to secure the flange 78 against the flange 85, one of the pairs of bores 80*a*, 80*b*, or 80*c* of the flange 78 should be aligned with the bores 86 of the flange 85. A pin, such as a cotter pin (not shown), may then be inserted through the bores 86 and the aligned pair of bores 80*a*, 80*b*, or 80*c*. The angular position of the arm 77 with respect to the support arm 40 may be adjusted by partially loosening the threaded stud; removing the cotter pin; placing the bores 86 in alignment with a different pair of the bores 80*a*, 80*b*, and 80*c*; replacing the pin through the bores 89 and the different pair of bores 80*a*, 80*b*, and 80*c*; and re-tightening the threaded stud.

Changing the angular position of the arm 77 with respect to the support arm 40 permits the skater to practice or learn new body positions for counterbalancing centrifugal force, where the skater's shoulders define a line (not shown) that points either in front of, toward, or behind axis A. It has been found that the optimum shoulder positions for balancing during arcuate travel and efficiently applying skate force that counterbalances centrifugal force are those where the skater's shoulders, and thus the arm 77, define a line (not shown) that points behind axis A. Thus, the angular orientation of arm 77 relative to the arm 40 depicted in FIG. 1 is a preferred orientation for shoulder positioning for the skater who is proceeding along the arcuate path B in the direction of arrow b.

As another alternative, the arm 77 may be bent so that more distal portions of the arm 77 that are located away from the flange 78 may be oriented either upward away from the surface 14, or downward toward the surface 14. In this the arm 77 could be formed to permit simulated grasping of a hockey stick in grasping positions that simulate real-life hockey stick grasping positions by hockey players.

Returning to FIG. 3, components of the adjustable body support device 70, including the sleeve 72; the arm 77 and the flange 78 of the support arm structure 76; and the shaft 83 and flange 85 of the riser portion 82, may be made of any suitable high strength material including metal and high strength plastic. The components of the adjustable body support device 70 are preferably made of aluminum.

The adjustable body support device 70 may be either fixedly or adjustably attached to the support arm 40 of FIG. 1. For example, the distal end 44 of the support arm 40 may be weldably attached to the sleeve 72. Alternatively, as best depicted in FIG. 3, the adjustable body support device 70 may be fixedly attached to an insert structure 90 that slidably fits inside the tubing of the support arm 40. The insert structure 90 may include a cylindrical rod 91 that is welded at one end to the sleeve 72. A tubular insert 92 with opposing end holes 94 may then be slidably positioned on the rod 91, by sliding the holes 94 over the rod 91, to form the insert structure 90. (Only one of the holes 94 is shown in FIG. 3).

The tubular insert 92 has the same cross sectional shape as the support arm 40, but has slightly smaller dimensions than the interior of the arm 40. This permits the tubular insert 92 to be slidably received within the arm 40. The tubular insert 92 includes a shoulder 96 that bears against the end of the support arm 40 and prevents the tubular insert 92 from sliding completely into the arm 40. Holes 99 bored through the distal end 44 of the support arm 40 may be aligned with holes 98 bored through the insert structure 90. After the holes 98, 99 are aligned, a pin (not shown) may be placed through the holes 99 and the holes 98 to fix the insert structure 90 within the arm 40 and to fix a distance D between the body support device 70 and axis A. The distance D between axis A and the body support device 70 may be made adjustable by lengthening the insert structure 90 and by including more holes 98 (not shown) along the length of the insert structure 90. The distance D could then be adjusted by aligning the holes 99 with holes 98 that are different from those depicted in FIG. 3, and by inserting the pin through the newly aligned holes 98, 99.

When the body support device 70 is included, the skater grasps the arm 77 of the body support device 70, rather than the distal end 44 of the support arm 40. By doing this, the skater is able to adjust the skater's angular position relative to the arm 40 by placing the bores 86 of the flange 85 in alignment with different pairs of the holes 80*a*, 80*b*, or 80*c* of the flange 78. Also, the skater is able to change the height $H_2$ of the support arm 76 above the surface 14 as already described. These adjustments of the height $H_2$ and the angular position of the arm 77 are especially useful when learning adjustments to body position and balance and variations in the cross-over technique that are needed for travel along arcuate paths with different radiuses from that of arcuate path B and for different speeds of travel along the various arcuate paths. The ability to change the distance D between the body support device 70 and axis A permits the user to change the centrifugal forces experienced at a particular arcuate path speed and also permits travel on different arcuate paths with different radiuses.

The training apparatus 10 may alternatively include a lockable single or multi-axis adjustment device (not shown) that is fixedly attached to the sleeve 72 and the rod 91. The single or multi-axis adjustment device permits reorientation of the axis C relative to the axis A and thereby presents additional opportunities for reorienting the arm 7 relative to the surface 14. For example, depending upon the degrees of freedom selected for the single or multi-axis adjustment device, the axis C could be rotated in any of a plurality of directions, such as any of the directions E, F, G, and H as best depicted in FIG. 1, prior to locking the single or multi-axis adjustment device to prevent further movement of the axis C. This ability to reorient the axis C thereby permits precise positioning of the arm 77 in a desired relation to the skater's body to further enhance opportunities for learning adjustments to body position and balance and variations, in the cross-over technique that are needed for travel along varying arcuate paths.

Figure 4:
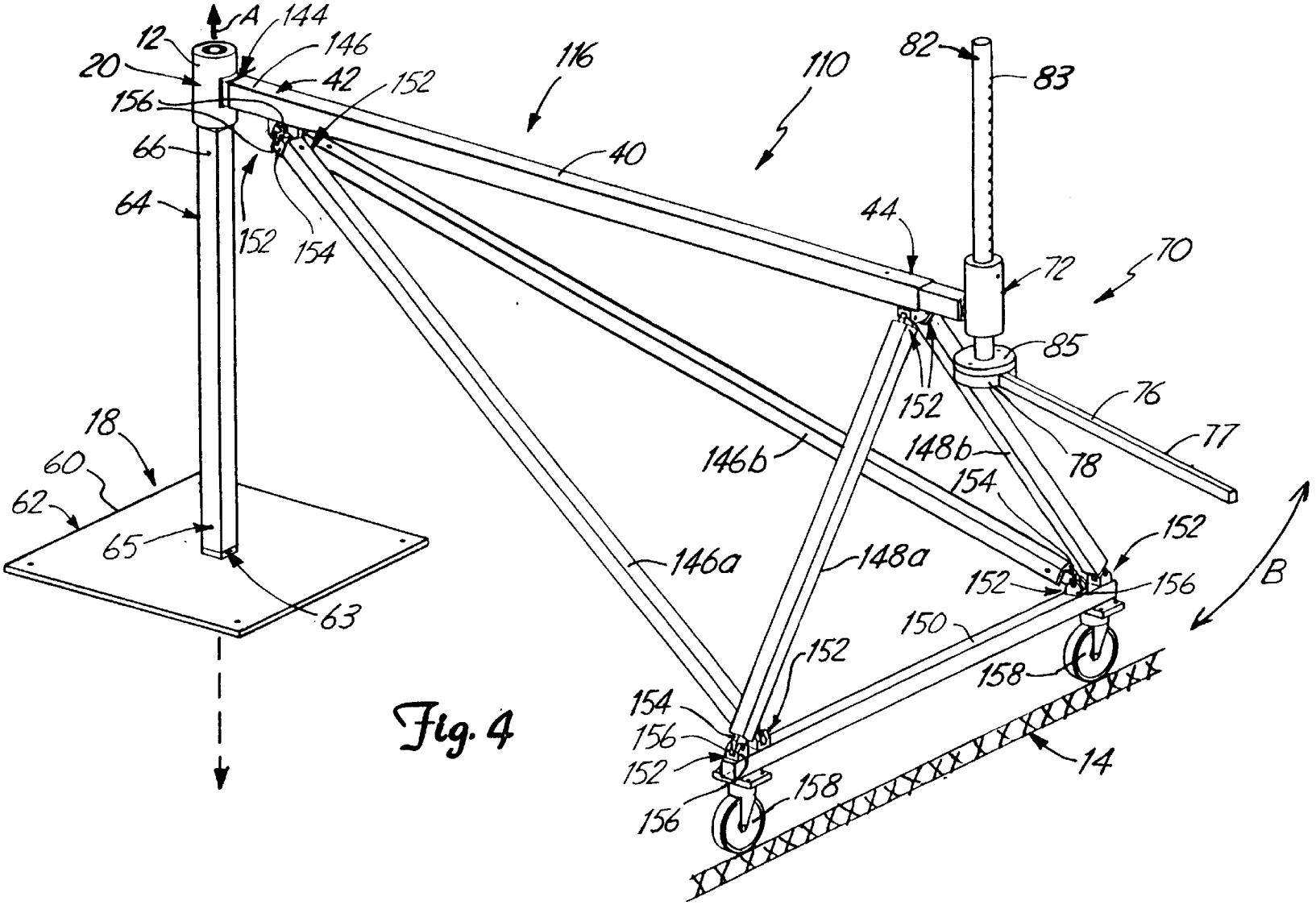
FIG. 4 is a perspective view of another training apparatus of the present invention.
Figure 5:
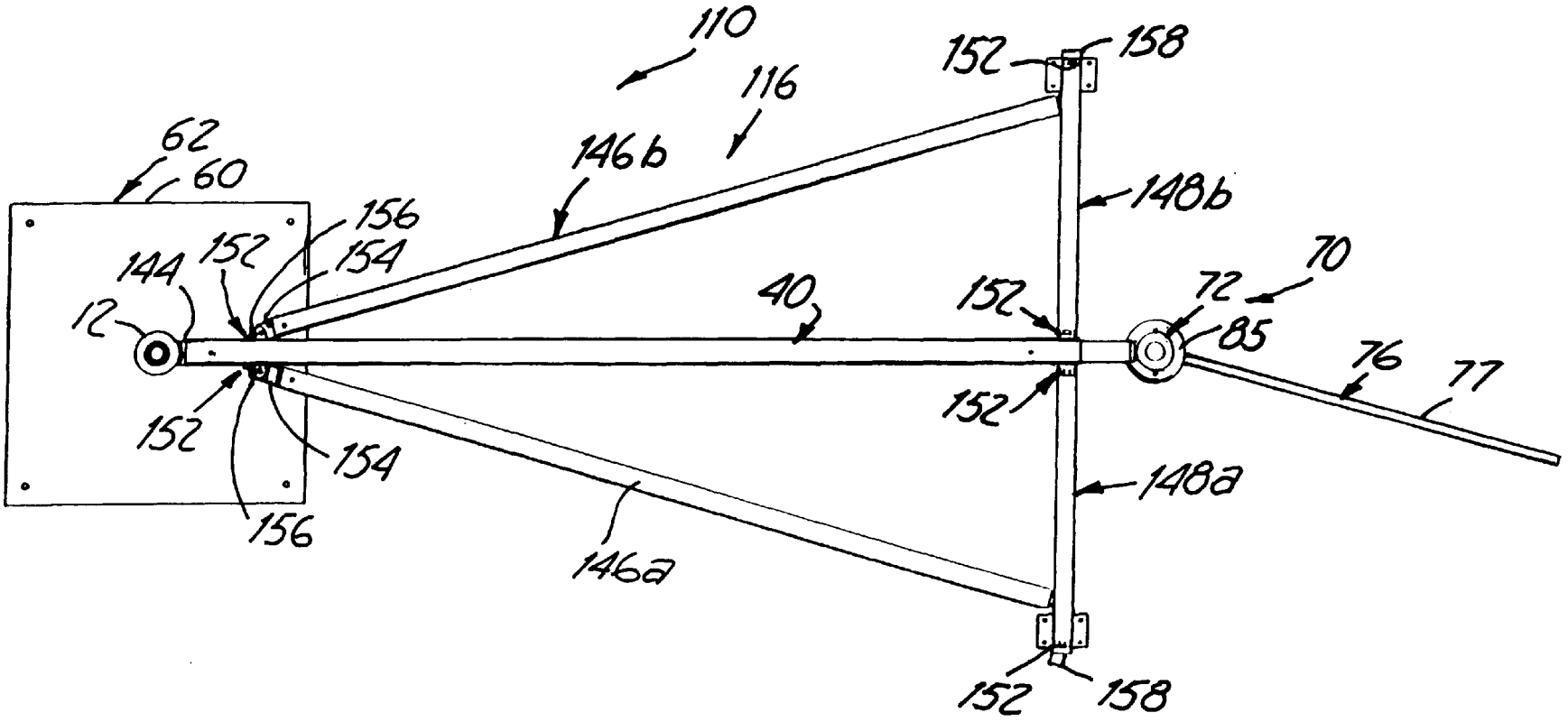
FIG. 5 is a top plan view of the training apparatus depicted in FIG. 4.

In a preferred embodiment, the training apparatus of the present invention may alternatively be configured like a training apparatus that is depicted at 110 in FIG. 4. The training apparatus 110, like the apparatus 10, includes the swivel 12, the support arm 40, and the base 60. However, the apparatus 110 includes a rotatable support 116, in place of the rotatable support 16 that is included in the apparatus 10. The rotatable support 116 includes the support arm 40 and the adjustable body support device 70. The adjustable body support device 70 may be either fixedly or adjustably attached to the support arm 40, as already discussed.

The proximal end 42 of the support arm 40 may be fixedly attached to the outer case of the swivel 12, such as by welding. Alternatively, the swivel 12 may include a stub 144 that is fixedly attached to the swivel 12. The stub 144 is adapted to slidably fit within the proximal end 42 of the support arm 40. The stub 144 includes a bore (not shown) that aligns with holes 146 extending through the support arm 40 so that a pin (not shown) may be inserted through the holes 146 and the bore of the stub 144 to releasably attach the support arm 40 to the stub 144.

The rotatable support 116 also includes braces 146*a*, 146*b*, braces 148*a*, 148*b*, and cross brace 150. One end of each of the braces 146*a*, 146*b* is attached to the support arm 40, at the proximal end 42, so that the attached ends of the braces 146*a*, 146*b* are adjacent to each other. Preferably, the ends of the braces 146*a*, 146*b* are releasably attached to the support arm 40 using a suitable releasable attachment mechanism. One suitable releasable attachment mechanism is an attachment device 152 that includes a tongue component 154 and a flap component 156. One tongue component 154 is attached to one end of each brace 146*a*, 146*b* and a pair of the flap components 156 are attached to the support arm 40. The tongue (not shown) of each tongue component 154 is inserted between parallel flaps (not shown) of each respective flap component 156 and is held in place in the flap component 156 by a pin inserted through aligned bores (not shown) extending through the parallel flaps and the tongue.

Another end of the brace 146*a* is attached to an end of the cross brace 150, and another end of the brace 146*b* is attached to an opposing end of the cross brace 150. The ends of the braces 146*a*, 146*b* that are attached to the ends of the cross brace 150 are preferably releasably attached to the cross brace 150 using the device 152 that includes the tongue component 154 and the flap component 156.

Also, one end of each of the braces 148*a*, 148*b* is attached to the distal end 44 of the arm support 40, so that the attached ends of the braces 148*a*, 148*b* are adjacent to each other. Other ends of the braces 148*a*, 148*b* are attached to respective opposing ends of the cross brace 150. adjacent to where the braces 146*a*, 146*b* are attached to the cross brace 150. Preferably, the ends of the braces 148*a*, 148*b* are releasably attached to both the support arm 40 and the cross brace 150, using the attachment device 152 that includes the tongue component 154 and the flap component 156.

The rotational support 116 also includes a pair of wheels 158 that are rotatably attached to respective ends of the cross brace 150, opposite the points where the braces 146*a*, 148*a* and the braces 146*b*, 148*b* are attached to the cross brace 150. The wheels 158 permit the rotational support 116 to roll along the surface 14 about axis A as the person grasps the support arm 76 to move either forward or backward along the arcuate path B about axis A. The rotational support 116 that includes the wheels 158 permits the support arm 40 to be longer in the apparatus 110, as compared to the apparatus 10, so that arcuate paths with longer radii may be utilized for training.

The rotational support 116 may also include an extension arm (not shown) that is attached to the swivel 12, such as with the stub 144, and to the proximal end 42 of the support arm 40. One suitable technique for connecting the extension arm and the support arm 40 is a flanged connection, although other connection techniques could be used. No other additions, such as additional braces or supports would be needed to incorporate the extension arm into the support 116. Incorporation of the extension into the training apparatus 110 is one way of increasing the radius of arcuate path B.

The base 60 supports the swivel 12 and the rotational support 116 via the cylindrical tube 68 (not shown in FIG. 4) that extends into both the bearing (not shown) of swivel 12 and the extension 64. The extension 64 may consist of a length of aluminum tubing that may be rectangular or circular in cross section, but is preferably square in cross section. The extension 64 is of appropriate length, such as from about two to about four feet, so that the support arm 76 may be adjusted to be approximately at waist height for both young and older persons who use the training apparatus 110 for arcuate path training or exercising.

The components of the training apparatus 110, including the bearing and outer case 20 of the swivel 12; the arm 40, braces 146*a*, 146*b*, 148*a*, 148*b*, 150, components of the body support device 70, and the extension arm; and components of the center support 18, may be made of any suitable high strength material including metal and high strength plastic. The components of the training apparatus 110 are preferably made of aluminum.

Figure 6:
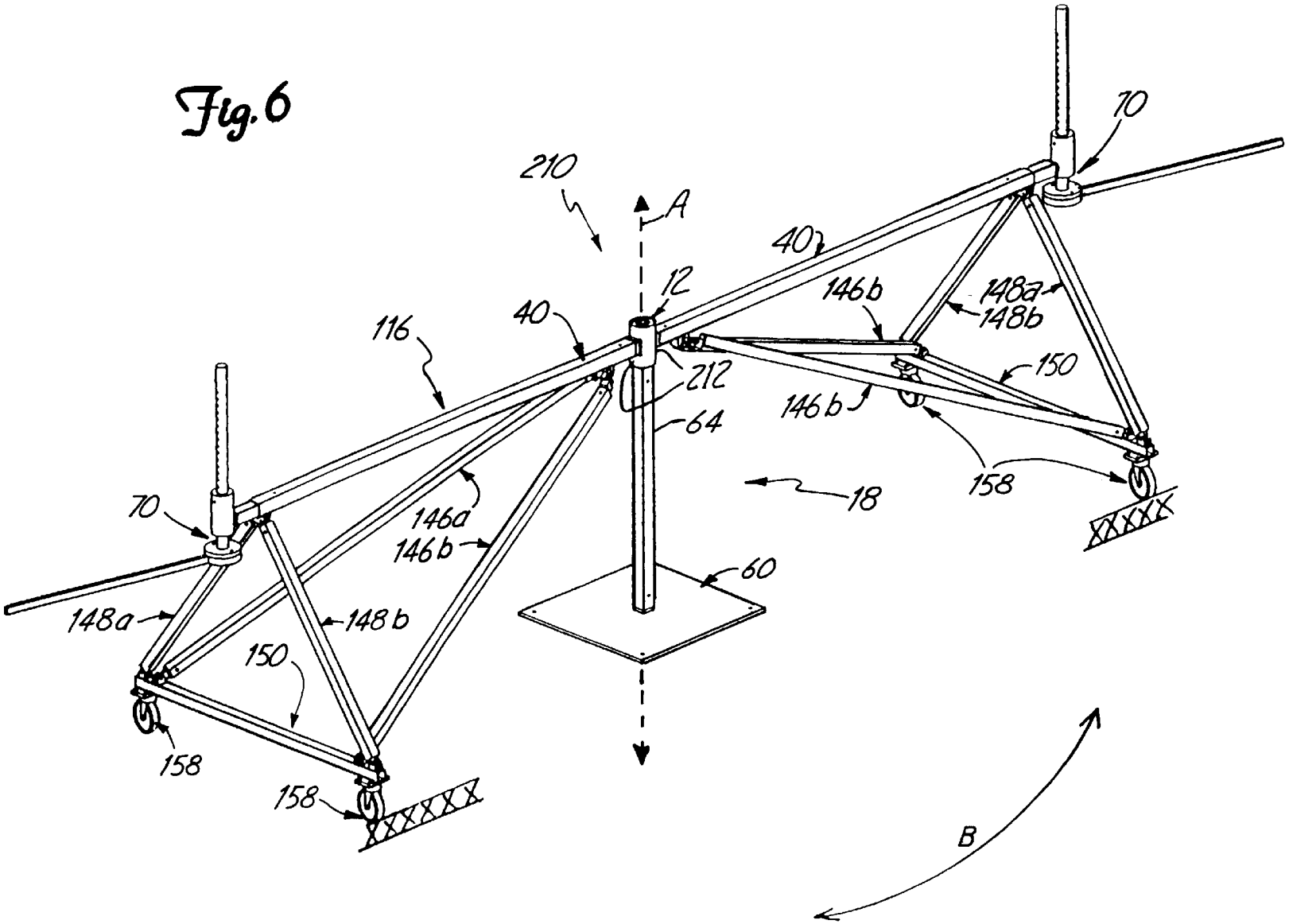
FIG. 6 is a perspective view of another training apparatus of the present invention.

The present invention may also take the form of a training apparatus, such as at 210 in FIG. 6, that includes two or more of the supports 116. In the apparatus 210, the two supports 116 are attached to opposing sides 212 of the swivel 12. With this arrangement, the apparatus 210 may be used to train two skaters in the same space that is required for using the apparatus 110 to train a single person. It should be recognized that any two skaters grasping the support arms 76 of the apparatus 210 may not contribute equal amounts of energy to propelling the rotational supports 116 about axis A. Thus, the device 210 may best be utilized for teaching proper skating techniques, such as the cross-over skating technique.

It is to be understood that, though the training apparatus of the present invention has been described in the context of skating and skiing, it is equally applicable to other activities where supported movement about an arcuate path would be useful. For example, it is believed that the training apparatus of the present invention would be beneficial for teaching people to walk, such as with the help of a wheeled walker attached to the inventive apparatus; for supporting people who are learning to walk again after debilitating diseases; and for rehabilitating injured persons, such as athletes and accident victims.

Additionally, it is to be understood that a variety of drive, braking, and control mechanisms may be incorporated to supplement the basic features of the inventive apparatus. For example, motors; springs; and self-perpetuating devices, such as fly wheels, could be connected to drive the rotating support 16 or the rotating support 116. Also, resistance mechanisms could be engaged with the apparatus 10 or the apparatus 110 to enhance the amount of energy needed to revolve the support 16 or the support 116 about axis A. Furthermore, various braking mechanisms could be connected to the apparatus 10 or apparatus 110 to help bring the support 16 or the support 116 to a stop. Finally, various control mechanisms could be incorporated in the components of the apparatus 10 or the apparatus 110 to guide the training or exercise regimen.

Figure 7:
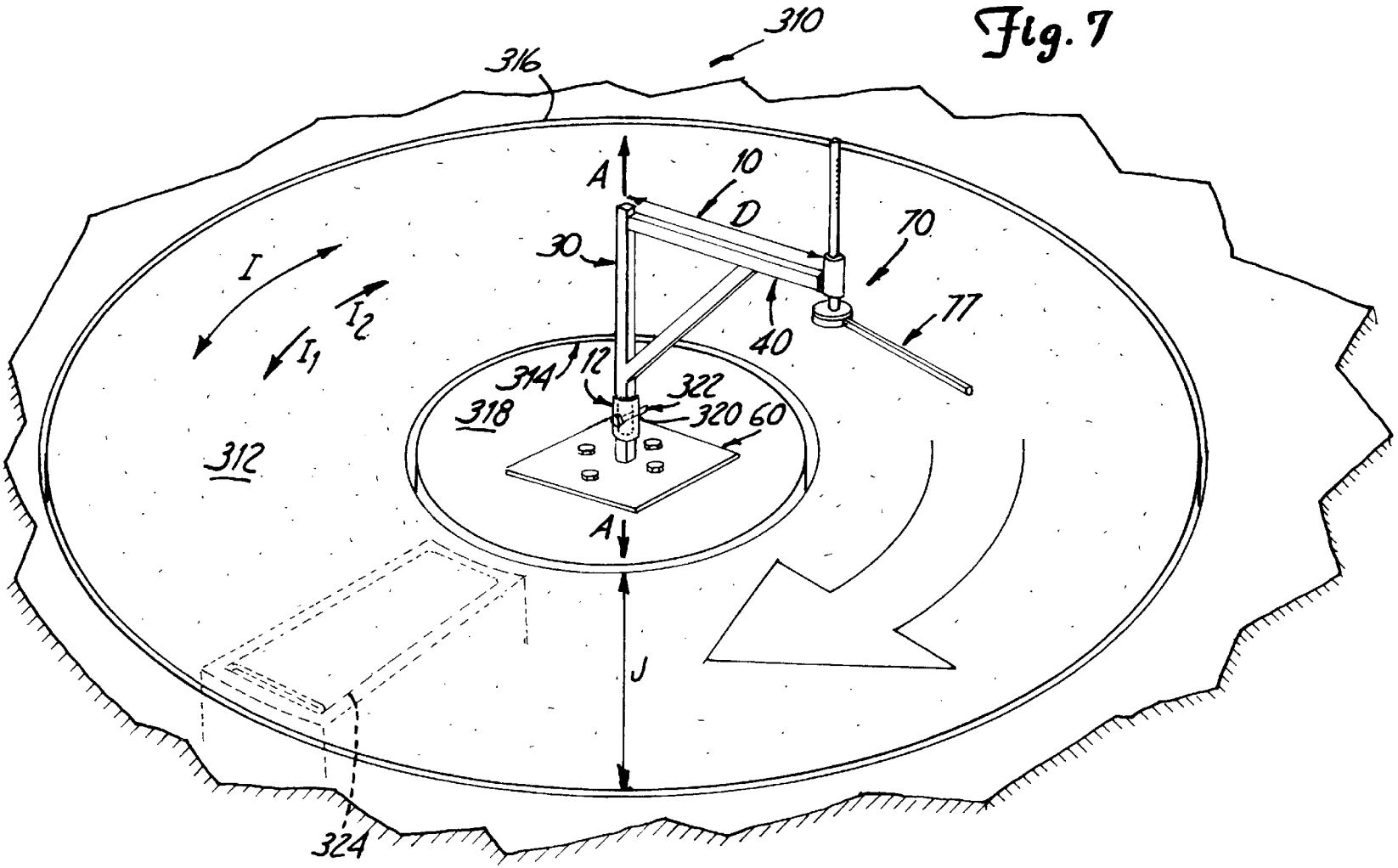
FIG. 7 is a perspective view of another training apparatus of the present invention.

As another alternative, the apparatus 10 may be incorporated into a system 310, as best depicted in FIG. 7. The system 310 includes a movable training surface 312 that rotates along an arcuate path I, in either direction $I_1$ or direction $I_2$. The training surface 312 may have an inner radius 314 and an outer radius 316. The base 60 of the apparatus 10 is fixedly attached to a stationary ground surface 318 interior to the inner radius 314 of the movable training surface 312. The movable training surface 312 is placed with respect to the body support device 70 to the skater to grasp the arm 77 while maintaining the skater's feet in skating contact with the training surface 312. A distance J between the inner radius 314 and the outer radius 316 of the training surface 312 may be selected to permit changes in the distance D between the body support device 70 and axis A while maintaining the skater's feet in skating contact with the training surface 312.

The system 310 presents additional options for practicing proper skating techniques. For example, the arm 40 along with the body support device 70 may be permitted to rotate about the axis A while simultaneously permitting the training surface 312 to move along the arcuate path I. Alternatively, the swivel 12 and the cylindrical tube 68 may include surfaces (not shown) that define a bore 320 through both the swivel 12 and the cylindrical tube 68. A pin 322 may then be inserted through the bore 320 to lock the vertical support portion 30 with respect to the base 60 and thereby prevent rotation of the arm 40 and body support device 70 about the axis A, while simultaneously permitting the training surface 312 to move along the arcuate path I.

The training surface 312 may be permitted to move along the path I solely by application of force by the skater's skates against the surface 312 while the skater grasps the arm 77. When this mechanism is desired, suitable bearings, such as roller bearings (not shown), are supported between the ground surface 318 (which extends beneath the training surface 312) and the training surface 312 and in contact with the training surface 312 to minimize frictional forces acting against movement of the training surface 312 in directions $I_1$ or $I_2$ and thereby minimize the amount of applied force needed by the skater's skate to initiate and maintain movement of the surface 312.

Alternatively, a force application device (not shown) could be positioned with respect to the training surface 312 to permit some rotation of the surface 312 by application of force by the skater's skates while maintaining a select amount of friction force against the surface 312 for purposes of exercising and building particular muscle groups of the skater. In yet another alternative, the system 310 may include a motor drive 324 in engagement with the surface 312, along with the aforementioned bearings, to permit the skater to practice the skating technique without the need of applying force against the skating surface with the skates for purposes of initiating or maintaining motion of the training surface 312 in direction $I_1$ or $I_2$.

As yet another alternative, the apparatus 110 (not shown in FIG. 7) may be substituted in place of the apparatus 10 in the system 310, while including the pin 322 within the swivel 12 to prevent rotation of the arm 40 and body support device 70 of the apparatus 110 about the axis A. Alternatively, the pin 322 may be excluded to permit rotation of the arm 40 and body support device 70 of the apparatus 110 about the axis A in the system 310. When the apparatus 110 is substituted in place of the apparatus 10 in the system 310, the wheels 158 may be either positioned on the surface 312 or the position 318, by appropriately adjusting the distance D or the distance J. Alternatively, if the pin 322 is included to prevent movement of the arm 40 and the body support device 70 with respect to the axis A, the wheels 158 may be excluded from the device 110 if the cross brace 150 is positioned against the surface 318.

The afore-mentioned cross-over skating techniques described with respect to the apparatus 10 and the apparatus 110 and the surface 14 are also capable of being practiced with the system 310. The only difference is that additional options in exertion and orientation are presented due to the ability to either (1) fix the arm 40 and the body support device 70 relative to the axis A while permitting movement of the surface 312 in direction $I_1$ or $I_2$ or (2) permit rotation of the arm 40 and the body support device 70 about the axis A while simultaneously permitting movement of the surface 312 in direction $I_1$ or $I_2$.

Although the present invention has been described with reference to preferred embodiments, workers skilled in the art will recognize that changes may be made in form and detail without departing from the spirit and scope of the invention.

What is claimed is:

1. An exercise apparatus, the apparatus comprising:

a first member disposed along a first axis that intersects a ground surface, the first member comprising a pivot mechanism;

a radial member, the radial member attached to the pivot mechanism for rotation of the radial member about the first axis; and a support surface, the support surface rotating substantially around said first member while supporting a skater thereon and said support surface supported by a friction reducing mechanism.

2. The apparatus of claim 1 wherein the pivot mechanism comprises a bearing that supports free rotation of the radial member about the first axis.

3. An exercise apparatus, the apparatus comprising:

a first member disposed along a first axis that intersects a ground surface;

a radial member, the radial member attached to the first member; and a support surface, the support surface capable of moving along an arcuate path relative to the first member;

a guide disposed along a second axis that intersects the ground surface, the guide attached to the radial member; and a support member attached to the guide, the support member selectively rotatable about the second axis, the support member capable of being grasped by a skater to support the skater.

4. The apparatus of claim 3 wherein the height of the support member is adjustable relative to the height of the support surface.

5. The apparatus of claim 3 wherein the support member comprises a support arm that is selectively rotatable about the second axis, the support arm capable of being grasped by the skater to support the skater.

6. The apparatus of claim 3 wherein the orientation of the second axis with respect to the first axis is capable of being changed relative to the first axis.

7. The apparatus of claim 3 wherein at least a portion of the support surface is located between the ground surface and the support member, the support surface movable about the first axis relative to at least the ground surface or the support member.

8. The apparatus of claim 3 wherein the second axis is distinct from the first axis.

9. The apparatus of claim 1 wherein the radial member is fixedly attached to the first member.

10. The apparatus of claim 1 wherein the first member comprises a center post that extends along the first axis.

11. The apparatus of claim 1 wherein the radial member comprises a boom.

12. An exercise apparatus, the apparatus comprising:

a first member disposed along a first axis that intersects a ground surface;

a radial member, the radial member attached to the first member and the radial member having a distal end and a proximal end;

a support surface, the support surface capable of moving along an arcuate path relative to the first member and the racial member having a preselected orientation relative to at least the ground surface or the support surface; and a support, the support attached to the radial member between the distal end and the proximal end of the radial member, and the support in working relation with the ground surface or the support surface to maintain the preselected orientation of the radial member relative to at least the ground surface or the support surface.

13. The apparatus of claim 12 wherein the support is attached to the radial member proximate the distal end of the radial member.

14. The apparatus of claim 12 wherein the support is in movable contact with the ground surface or the support surface.

15. The apparatus of claim 14 wherein the support further comprises a wheel that is in rollable contact with the ground surface or the support surface.

16. The apparatus of claim 12 wherein the support is in stationary contact with the ground surface.

17. The apparatus of claim 1 wherein the support surface is capable of moving about the first axis along a path that defines a circle.

18. A skate training apparatus, the apparatus comprising:

a center post disposed along a first axis that intersects a ground surface;

a boom assembly having a distal end and a proximal end, the boom assembly rotatably attached to the center post at the proximal end; and a skating surface, the skating surface capable of moving along a circular path about the center post while supporting a skater, at least a portion of the skating surface capable of passing beneath the distal end of the boom assembly.

19. The apparatus of claim 18, and further comprising:

a guide disposed along a second axis that intersects a ground surface, the guide attached to the boom assembly, and a support member attached to the guide, the support member selectively rotatable about the second axis, the support member capable of being grasped by a skater to support the skater.

20. The exercise apparatus of claim 3 wherein the support member is selectively rotatable to at least three different angular positions about the second axis relative to the guide, the support member capable of being fixedly positioned relative to the guide at each of the at least three different angular positions.

21. The exercise apparatus of claim 3 wherein the guide is selectively positionable along the second axis to change the height of the support member relative to the ground surface or relative to the support surface.

* * * * *

UNITED STATES PATENT AND TRADEMARK OFFICE

CERTIFICATE OF CORRECTION

PATENT NO. : 6,090,015

DATED : JULY 18, 2000

INVENTOR(S) : DAVID W. MEYERS

It is certified that error appears in the above-identified patent and that said Letters Patent is hereby corrected as shown below:

Col. 2, line 11, delete "failing", insert -- falling --

Col. 2, line 57, delete "tend", insert -- end --

Col. 4, line 11, delete 'nd", insert -- and --

Col. 4, line 33, delete "aim", insert -- arm --

Col. 5, line 52, delete "trig", insert -- training --

Col. 6, line 42, delete "improved", insert -- moved --

Col. 6, line 58, delete "eight", isnert -- right --

Col. 7, line 30, delete "nay", insert -- may --

Col. 14, line 25, delete "racial", insert -- radial --

Signed and Sealed this

Twenty-second Day of May, 2001

*Attest:*

Nicholas P. Godici

NICHOLAS P. GODICI

*Attesting Officer*

*Acting Director of the United States Patent and Trademark Office*